US010894629B2

(12) United States Patent
Zhu

(10) Patent No.: US 10,894,629 B2
(45) Date of Patent: Jan. 19, 2021

(54) COLLAPSIBLE BASKET SET

(71) Applicant: Shou Qiang Zhu, Ontario, CA (US)

(72) Inventor: Shou Qiang Zhu, Ontario, CA (US)

(73) Assignee: IP Power Holdings Limited, Hong Kong (CN)

( * ) Notice: Subject to any disclaimer, the term of this patent is extended or adjusted under 35 U.S.C. 154(b) by 0 days.

(21) Appl. No.: 16/515,931

(22) Filed: Jul. 18, 2019

(65) Prior Publication Data

US 2020/0024029 A1 Jan. 23, 2020

Related U.S. Application Data

(60) Provisional application No. 62/700,087, filed on Jul. 18, 2018.

(51) Int. Cl.
*B65D 6/16* (2006.01)
*B65D 25/22* (2006.01)

(52) U.S. Cl.
CPC ..... *B65D 11/18* (2013.01); *B65D 25/22* (2013.01)

(58) Field of Classification Search
CPC .... B65D 11/18; B65D 21/0233; B65D 21/04; B65D 21/041; B65D 25/22
USPC ..... 206/372, 373, 379, 505, 507; 220/485; 47/75, 78; 312/298, 300, 308
See application file for complete search history.

(56) References Cited

U.S. PATENT DOCUMENTS 1,131,128 A * 3/1915 Goodman ..... A47B 51/00 312/272
1,667,938 A * 5/1928 Labadie ..... G09F 5/02 206/373
2,645,538 A * 7/1953 Segal ..... A47B 9/00 108/145
3,001,845 A * 9/1961 Thompson ..... A47B 88/70 312/272.5
4,173,284 A * 11/1979 March ..... B25H 3/023 206/349
5,611,170 A * 3/1997 McGuff ..... A01K 97/06 43/54.1
2004/0168941 A1* 9/2004 Cho ..... A45C 11/24 206/373

* cited by examiner

*Primary Examiner* — Luan K Bui
(74) *Attorney, Agent, or Firm* — Che-Yang Chen; Law Office of Michael Chen

(57) ABSTRACT

In one aspect, a collapsible basket set may include a plurality of baskets, a base, and a pair of connecting members on two opposite sides of the baskets, wherein each connecting member has a plurality of connecting units to form one or more quadrilateral connecting structures pivotally connecting with each other so the basket set begins to collapse when each quadrilateral connecting structure becomes flattener, and the basket set totally collapses when the quadrilateral connecting structures disappears. In one embodiment, each connecting member includes a locking bar to secure the basket set when it is fully extended.

3 Claims, 5 Drawing Sheets

COLLAPSIBLE BASKET SET

CROSS-REFERENCE TO RELATED APPLICATIONS

This application claims priority under 35 U.S.C. § 119 (e) to U.S. Provisional Patent Application Ser. No. 62/700,087, filed on Jul. 18, 2018, the entire contents of which are hereby incorporated by reference.

FIELD OF THE INVENTION

The present invention relates one or more hanging baskets, and more particular to collapsible baskets, the size of which can be significantly minimized when not in use.

BACKGROUND OF THE INVENTION

Conventionally, the structure of an item storage set may be rigid so the size of the storage set cannot be easily minimized. If a storage set is structurally rigid, one has to evaluate the size of the room and make an area especially for the storage set before purchasing. In such a case, when the storage set is not in use, the user may have to get rid of it or find another space to dispose the storage set because it may occupy too much space in the room.

Recently, various constructions of readily collapsible readily erectable structures for item storage sets are known to resolve the problems stated above. These constructions commonly employ articulated arm arrangements, lazytongs frames or like foldable expandable elements which are movable in a certain manner to form the structure. Most of such constructions involve plural and sometimes complicated manipulations of the structure to effect erection or folding. Another drawback with these known structures is that in some instances a single size capacity can be too large or too small for the user's need or convenience. Therefore, there remains a need for a new and improved collapsible structure for an item storage set to overcome the problems stated above.

SUMMARY OF THE INVENTION

It is an object of the invention to provide a collapsible basket set that is collapsible to minimize the size thereof when not in use.

It is a further object of the present invention to provide a collapsible basket set that has a less complicated folding structure so the entire collapsible basket set is light and easy to move and carry.

In one aspect, a collapsible basket set may include a plurality of baskets, a base, and a pair of connecting members on two opposite sides of the baskets. In one embodiment, each basket is secured at a predetermined position at each connecting member and when the basket set is collapsed, the size of the basket set can be significantly reduced because the baskets can all be stacked up and the connecting members can be flattened to minimize the space occupied.

In one embodiment, each connecting member may include a plurality of connecting units that are pivotally connect to each other. More specifically, a quadrilateral connecting structure including four connecting units can be pivotally formed between two baskets. For example, the basket set has three baskets and the connecting member may include two quadrilateral connecting structures pivotally connected with each other on two opposite sides of the baskets.

Each connecting member may include a locking bar to secure the structure of the basket set when it is fully extended. In one embodiment, one end of the locking bar is pivotally connected to a center portion of the quadrilateral connecting structure close to the base, and the other end of the locking bar has a locking unit to engage with a protruding bar. Namely, the locking bar horizontally traverses a center portion of the lower quadrilateral connecting structure to secure the basket set when it is fully extended.

The collapsible basket set may further include a handle pivotally connected to the basket at the very top of the basket set so the user can carry the basket set no matter it is extended or collapsed. Since the structure of the basket set is secured by the locking bar discussed above, the basket set can be used to received items on the baskets either when the basket set stands along or it can be hung on the wall through the handle, for example.

In an exemplary embodiment, the basket set can be collapsed when not in use. The user can simply disengage the locking unit of the locking bar and the protruding bar and slightly press the entire structure of the basket set, and the basket set may start to collapse. It is noted that the shape of each quadrilateral connecting structure starts to change during the collapse. More specifically, each quadrilateral connecting structure becomes flattener during the collapse and eventually the quadrilateral connecting structure disappears when the basket set is totally collapsed.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

Figure 1:
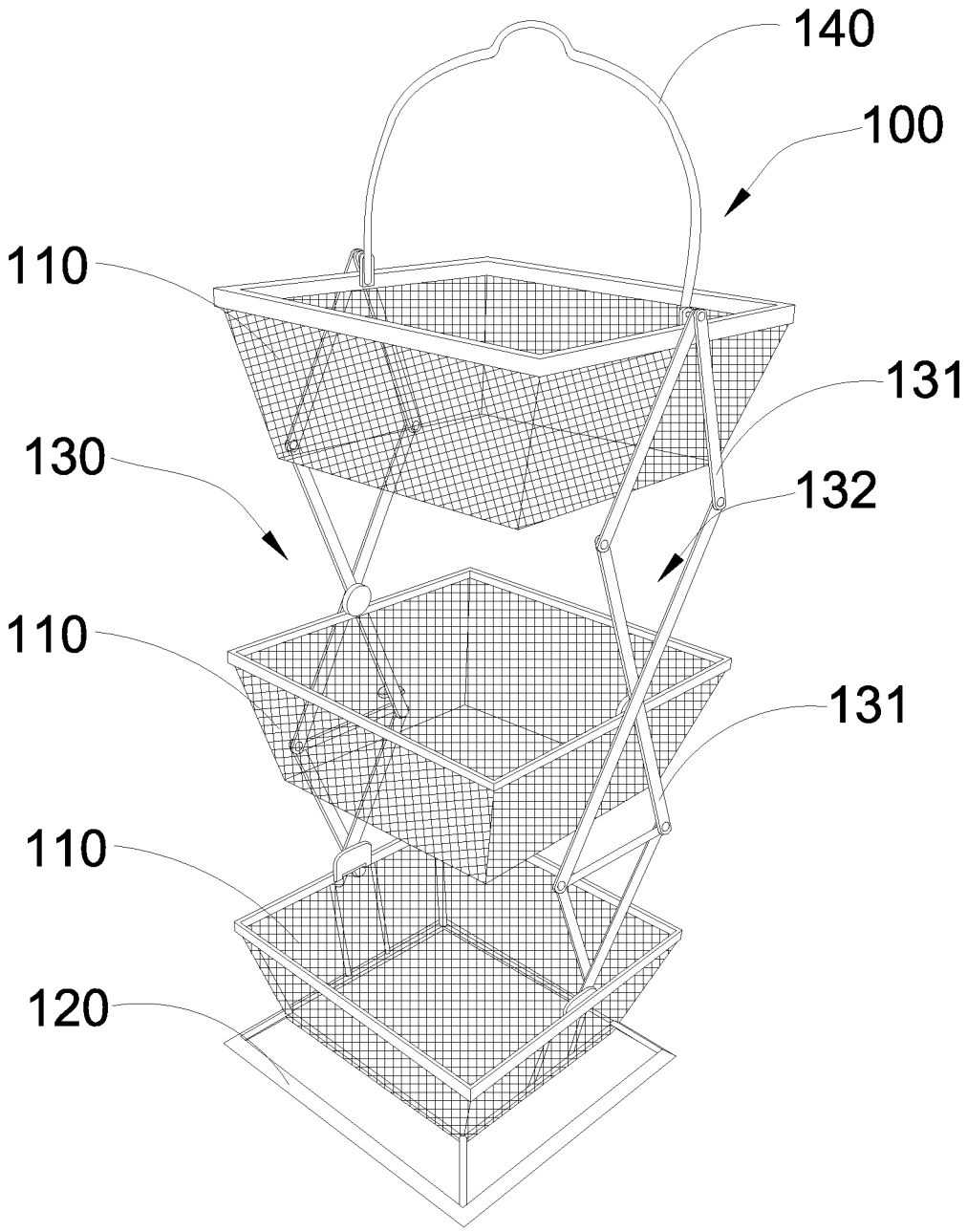
FIG. 1 is a schematic view of the collapsible basket set that is fully extended in the present invention.
Figure 2:
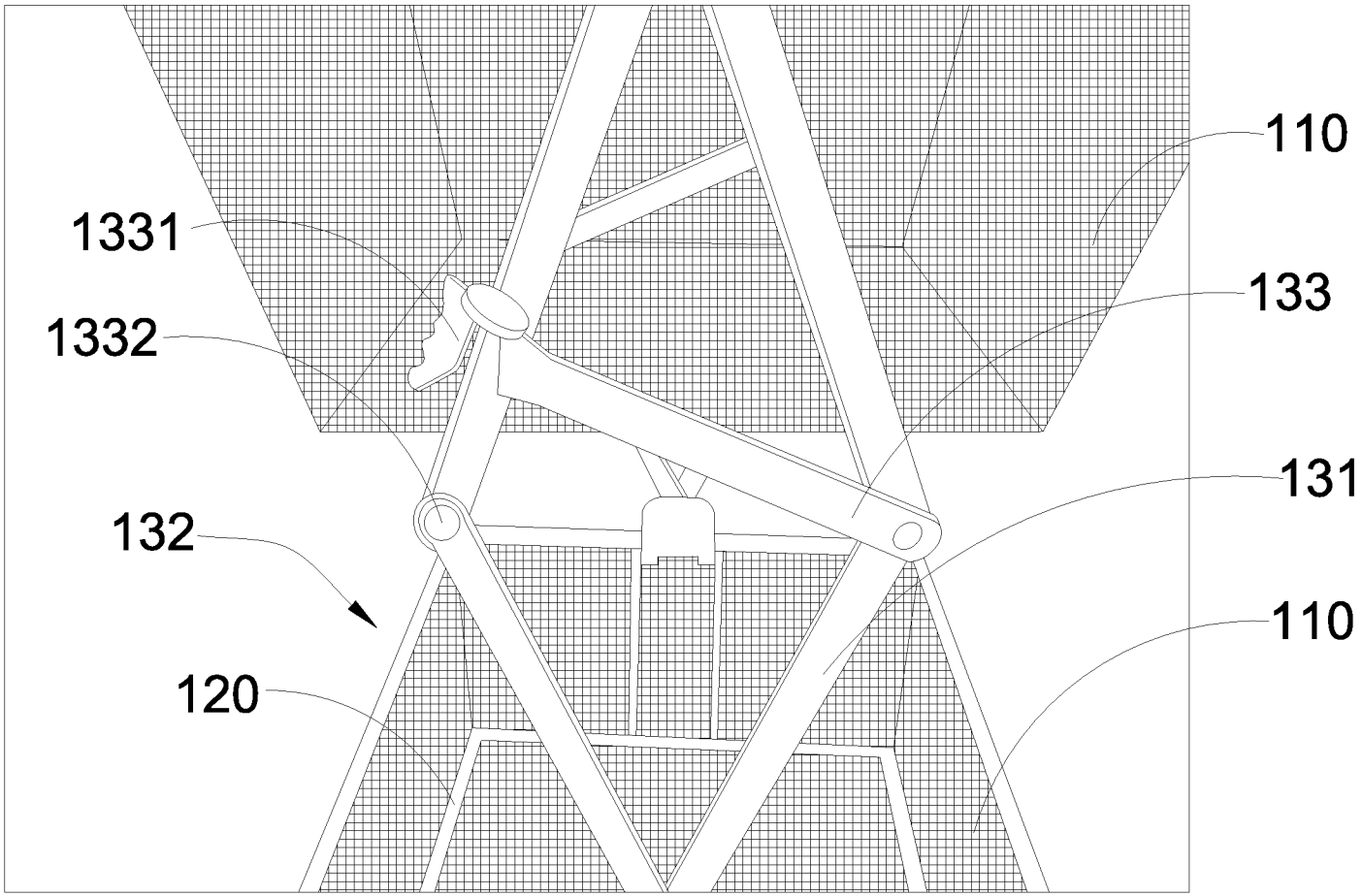
FIG. 2 is an enlarged view of the quadrilateral connecting structure including the locking bar to engage (or disengage) with the protruding bar to secure the entire basket set in the present invention.
Figure 3:
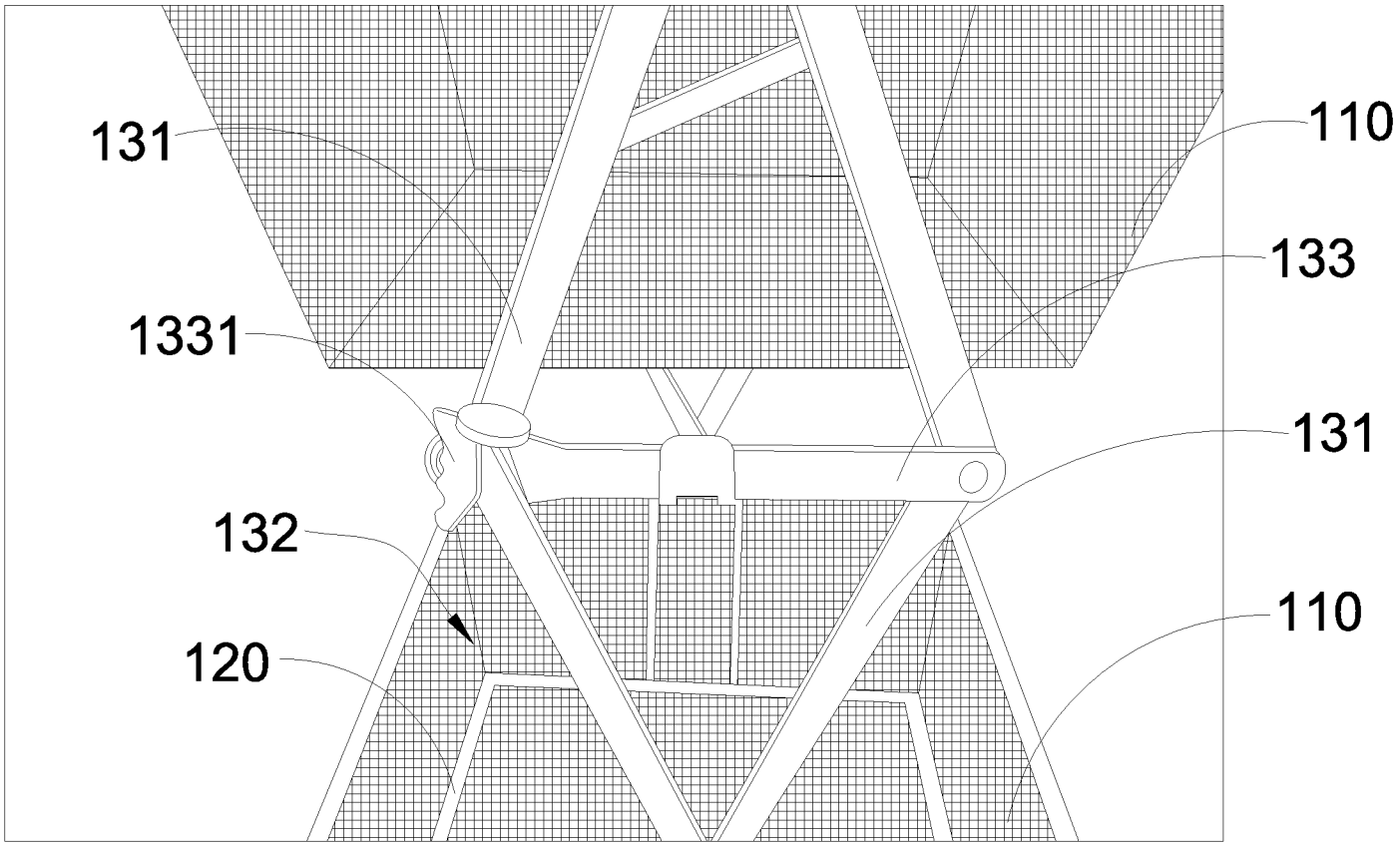
FIG. 3 is an enlarged view of the quadrilateral connecting structure including the locking bar engaging with the protruding bar to secure the entire basket set in the present invention.
Figure 5:
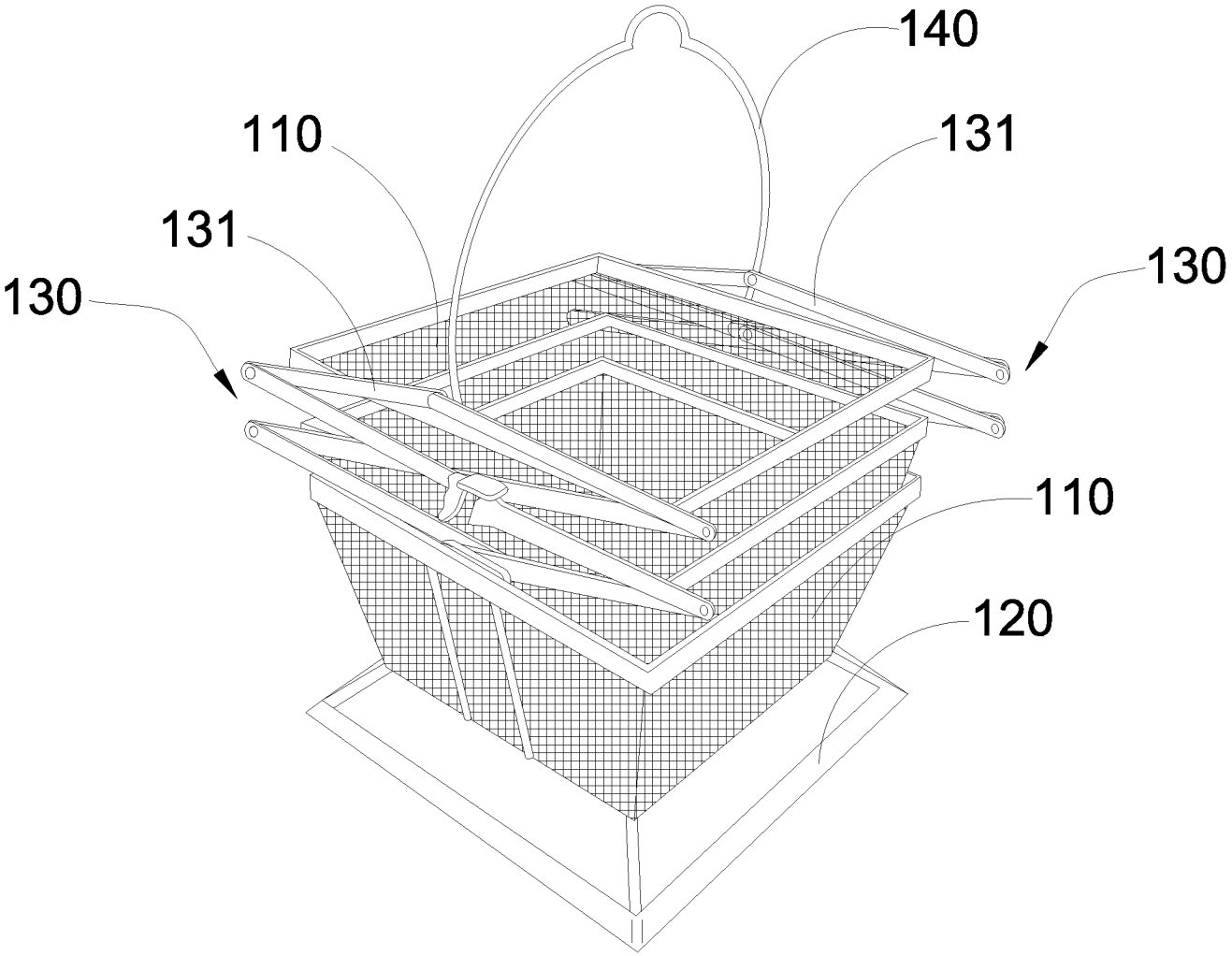
FIG. 5 is a schematic view of the basket set that is totally collapsed in the present invention.

In one aspect, referring to FIGS. 1 to 3, a collapsible basket set 100 may include a plurality of baskets 110, a base 120, and a pair of connecting members 130 on two opposite sides of the baskets 110. In one embodiment, each basket 110 is secured at a predetermined position at each side of the connecting member 130 and when the basket set 100 is collapsed, the size of the basket set 100 can be significantly reduced as shown in FIG. 5 because the baskets 110 can all be stacked up and the connecting members 130 can be flattened to minimize the space occupied.

In one embodiment, each connecting member 130 may include a plurality of connecting units 131 that are pivotally connect to each other. More specifically, as shown in FIGS. 1 to 3, a quadrilateral connecting structure including four connecting units 131 can be pivotally formed between two baskets 110. For example, as shown in FIG. 1, the basket set 100 has three baskets 110 and the connecting member 130 may include two quadrilateral connecting structures pivotally connected with each other on two opposite sides of the baskets 110.

Each connecting member 130 may include a locking bar 133 to secure the structure of the basket set 100 when it is fully extended. In one embodiment, as shown in FIGS. 2 and 3, one end of the locking bar 133 is pivotally connected to a center portion of the quadrilateral connecting structure 132 close to the base 120, and the other end of the locking bar 133 has a locking unit 1331 to engage with a protruding bar 1332 on an opposite side of the quadrilateral connecting structure 132. Namely, the locking bar 132 horizontally traverses a center portion of the lower quadrilateral connecting structure 132 to secure the basket set 100 when it is fully extended as shown in FIG. 3.

The collapsible basket set 100 may further include a handle 140 pivotally connected to the basket 110 at the very top of the basket set 100 so the user can carry the basket set 100 no matter it is extended or collapsed. Since the structure of the basket set 100 is secured by the locking bar 133 discussed above, the basket set can be used to received items on the baskets 110 either when the basket set 100 stands along as shown in FIG. 1 or it is hung on the wall (not shown) through the handle 140, for example.

Figure 4:
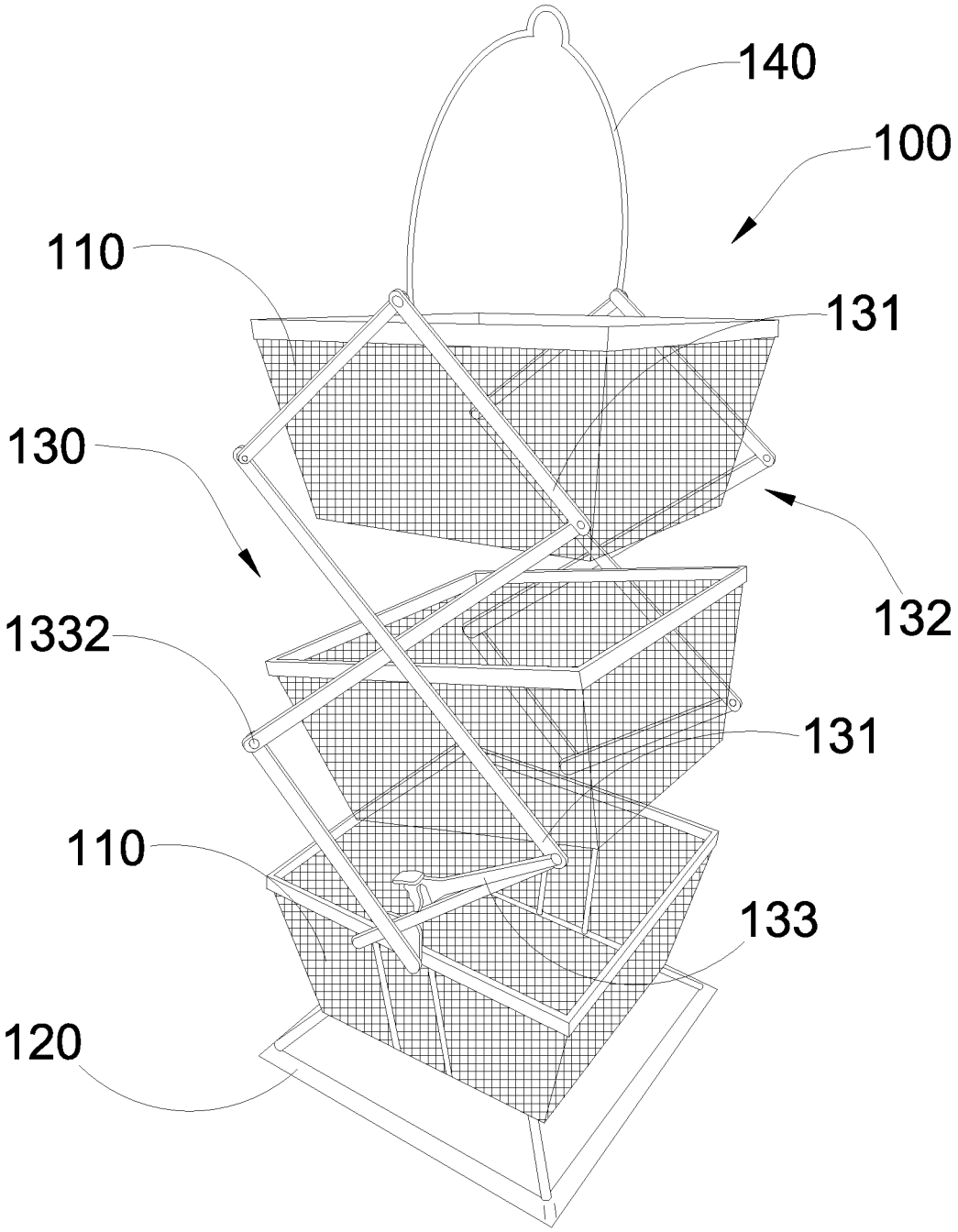
FIG. 4 is a schematic view of the basket set that is partially collapsed in the present invention.

In an exemplary embodiment, the basket set 100 can be collapsed when not in use. The user can simply disengage the locking unit 1331 of the locking bar 133 and the protruding bar 1332 as shown in FIG. 2 and slightly press the entire structure of the basket set 100, and the basket set 100 may start to collapse as shown in FIG. 4. It is noted that the shape of each quadrilateral connecting structure 132 starts to change during the collapse. More specifically, each quadrilateral connecting structure 132 becomes flattener during the collapse and eventually the quadrilateral connecting structure 132 disappears when the basket set 100 is totally collapsed as shown in FIG. 5.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A collapsible basket set comprising:

a plurality of baskets;

a base; and a pair of connecting members on two opposite sides of the baskets;

wherein each connecting member has a plurality of connecting units to form one or more quadrilateral connecting structures pivotally connecting with each other so the basket set begins to collapse when each quadrilateral connecting structure becomes flattener, and the basket set totally collapses when the quadrilateral connecting structures disappears, wherein each connecting member includes a locking bar to secure the basket set when it is fully extended, and one end of the locking bar is pivotally connected to a center portion of the quadrilateral connecting structure close to the base, and the other end of the locking bar has a locking unit to engage with a protruding bar on an opposite side of the quadrilateral connecting structure, wherein when the locking unit disengages with a protruding bar, the basket set begins to collapse when a pressure is applied to slightly push down the basket set.

2. The collapsible basket set of claim 1, wherein each basket is secured at a predetermined position at each side of the connecting member.

3. The collapsible basket set of claim 1, further comprising a handle pivotally connected to the basket located at the very top of the basket set.

* * * * *